US009427619B2

(12) United States Patent
Franks

(10) Patent No.: US 9,427,619 B2
(45) Date of Patent: Aug. 30, 2016

(54) PHYSICAL THERAPY SYSTEM WITH INTERCHANGEABLE HEADS

(71) Applicant: James Wesley Franks, Knoxville, TN (US)

(72) Inventor: James Wesley Franks, Knoxville, TN (US)

( * ) Notice: Subject to any disclaimer, the term of this patent is extended or adjusted under 35 U.S.C. 154(b) by 0 days.

(21) Appl. No.: 14/491,277

(22) Filed: Sep. 19, 2014

(65) Prior Publication Data

US 2015/0087486 A1 Mar. 26, 2015

Related U.S. Application Data

(60) Provisional application No. 61/880,452, filed on Sep. 20, 2013.

(51) Int. Cl.

| | |
|---|---|
| ***A63B 21/16*** | (2006.01) |
| ***A63B 22/00*** | (2006.01) |
| ***A63B 21/055*** | (2006.01) |
| ***A63B 21/04*** | (2006.01) |
| ***A63B 22/06*** | (2006.01) |
| ***A63B 23/035*** | (2006.01) |
| ***A63B 23/12*** | (2006.01) |
| ***A63B 21/062*** | (2006.01) |

(52) U.S. Cl.

CPC ..... *A63B 21/169* (2015.10); *A63B 21/0442* (2013.01); *A63B 21/0552* (2013.01); *A63B 22/0005* (2015.10); *A63B 22/0605* (2013.01); *A63B 22/0694* (2013.01); *A63B 23/03541* (2013.01); *A63B 21/0628* (2015.10); *A63B 22/0076* (2013.01); *A63B 22/0664* (2013.01); *A63B 23/1209* (2013.01)

(58) Field of Classification Search

CPC .. A63B 21/169; A63B 22/20; A63B 22/201; A63B 22/205; A63B 21/4045; A63B 21/1618–21/1663; A47C 17/38–17/50; A47F 5/0846; Y10T 16/353; Y10T 16/354

See application file for complete search history.

(56) References Cited

U.S. PATENT DOCUMENTS

| | | | | |
|---|---|---|---|---|
| 3,642,278 | A | 2/1972 | Hinckley | |
| 5,209,712 | A | 5/1993 | Ferri | |
| 5,558,607 | A | 9/1996 | Darling | |
| 5,586,941 | A * | 12/1996 | Klearman | A63B 69/3676 473/160 |
| 6,319,179 | B1 * | 11/2001 | Hinds | A63B 21/0552 482/121 |
| 6,698,603 | B2 | 3/2004 | Lawson et al. | |
| 6,890,288 | B2 | 5/2005 | Bingham | |
| 7,591,385 | B2 | 9/2009 | Brooks | |
| 7,722,514 | B2 | 5/2010 | Paine, Jr. | |
| 7,914,428 | B2 | 3/2011 | Piane, Jr. | |
| 8,047,972 | B1 | 11/2011 | Dean et al. | |
| 8,136,775 | B2 | 3/2012 | Chiang | |
| 2005/0029210 | A1 | 2/2005 | Perkins et al. | |
| 2008/0006592 | A1 | 1/2008 | Brooks | |
| 2012/0053028 | A1 * | 3/2012 | Campanaro | A63B 21/00072 482/131 |

* cited by examiner

*Primary Examiner* — Oren Ginsberg
*Assistant Examiner* — Jennifer M Deichl
(74) *Attorney, Agent, or Firm* — Pitts & Lake, P.C.

(57) ABSTRACT

A physical therapy system with interchangeable heads, generally including a base plate member that is detachably mounted onto a wall track member or similar assembly. The base plate member is capable of supporting, including, or incorporating a number of different heads—generally different pieces of exercise equipment or exercise machines.

17 Claims, 7 Drawing Sheets

PHYSICAL THERAPY SYSTEM WITH INTERCHANGEABLE HEADS

CROSS-REFERENCE TO RELATED APPLICATIONS

This application claims the benefit of U.S. Provisional Patent Application Ser. No. 61/880,452, filed on Sep. 20, 2013, the disclosure of which is incorporated by reference herein in its entirety.

STATEMENT REGARDING FEDERALLY SPONSORED RESEARCH OR DEVELOPMENT

Not Applicable

BACKGROUND OF THE INVENTION

1. Field of Invention

This invention pertains generally to exercise equipment and, more particularly, to wall-mounted exercise equipment.

2. Description of the Related Art

There is a need for a system permitting the use of interchangeable exercise equipment or exercise machines in situations where exercise space is at a premium and where it is desirable to be able to interchange exercise equipment or exercise machines in the same physical space

BRIEF SUMMARY OF THE INVENTION

In one example embodiment according to the present general inventive concept, a physical therapy system with interchangeable heads includes a detachable base plate member mounted onto (or attached to) a wall track member. The base plate member generally includes or supports a head component. The base plate member is mounted onto the track member, which includes a central grappling track and, generally, two or more recessed side tracks. The base plate member includes at least one hook, which is controlled or manipulated by a lever handle. When the base plate member is positioned in a certain way against the wall track member, and the lever handle is in a first position, the hook that is controlled by the lever handle engages with the grappling track. The coupling of the hook and the grappling track holds the base plate member in position at a selected vertical location, mounted on the wall track member. At the same time, in some example embodiments, the base plate member includes two positioning panels, which generally protrude orthogonally from the inboard face of the base plate member. When the base plate member is mounted onto the wall track member, the positioning panels line up with and interact with recessed side tracks of the wall track member. The positioning panels and recessed side tracks help to orient the base plate member during the mounting process and help to stabilize the base plate member once it is in position on the wall track member and the hook and grappling track have coupled. The vertical tracks allow the base plate member to be mounted onto the wall track member at any one of many possible vertical locations on a wall.

A physical therapy system with interchangeable heads according to the present general inventive concept, including a detachable base plate member and a wall track member, provides a means for mounting a selected head component or piece of exercise equipment or exercise machine onto a wall at a selected vertical location. A system according to the present general inventive concept has great potential application in situations where exercise space is at a premium and where it is desirable to be able to interchange exercise equipment or exercise machines in the same physical space. A system according to the present general inventive concept has great potential application in, for example, outpatient clinics, nursing facilities, and physical therapy suites. Such a system with interchangeable heads allows for cost savings and space savings.

BRIEF DESCRIPTION OF THE DRAWINGS

The above-mentioned and additional features of the invention will become more clearly understood from the following detailed description of the invention read together with the drawings in which.

DETAILED DESCRIPTION OF THE INVENTION

In some of its many embodiments, the present general inventive concept includes a physical therapy (or PT) system with interchangeable heads, generally including a base plate member that is detachably mounted onto a wall track member or similar assembly. The base plate member is capable of supporting, including, or incorporating a number of different heads—generally different pieces of exercise equipment or exercise machines (hereinafter "head components").

Figure 2:
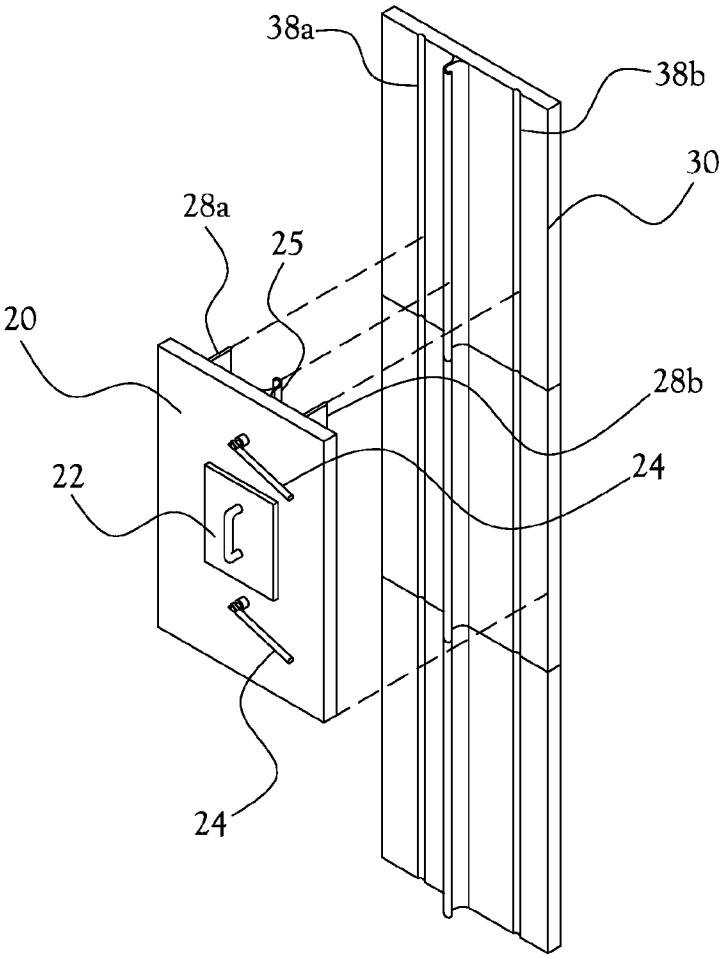
FIG. 2 is a partially exploded perspective view of the example embodiment shown in FIG. 1.
Figure 1:
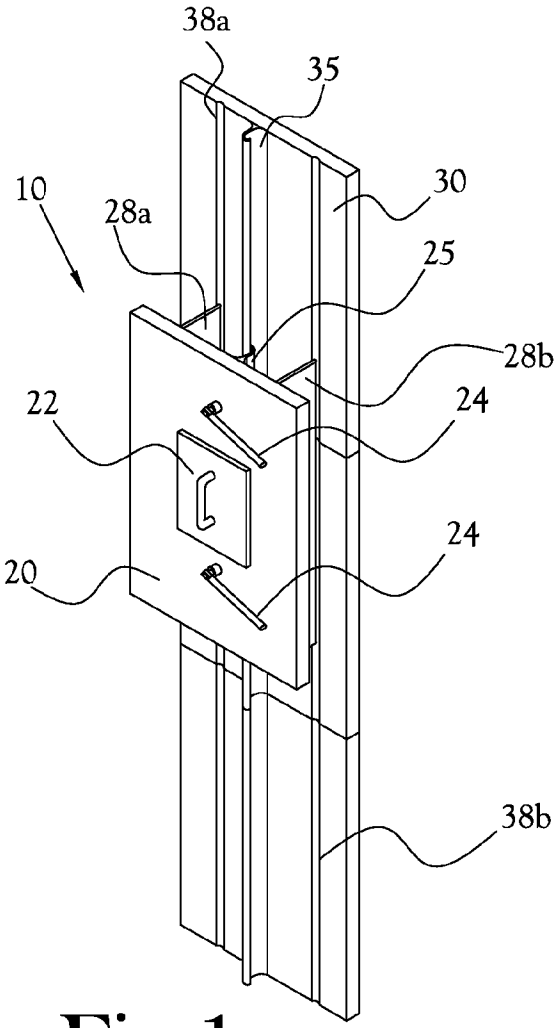
FIG. 1 is a perspective view of one example embodiment of a physical therapy system with interchangeable heads according to the present general inventive concept, showing a base plate member mounted onto a wall track member.

Turning to the figures, FIG. 1 illustrates one example embodiment of a PT system with interchangeable heads according to the present general inventive concept. As shown in FIG. 1 and in the partially exploded view in FIG. 2, the illustrated example embodiment system 10 includes a detachable base plate member 20 mounted onto (or attached to) a wall track member 30. The base plate member 20 generally includes or supports a head component 22. The base plate member 20 is mounted onto the track member 30, which includes a central grappling track 35 and, generally, two or more recessed side tracks (in the illustrated example embodiment, there are two such recessed side tracks, 38*a* and 38*b*).

Figure 3A:
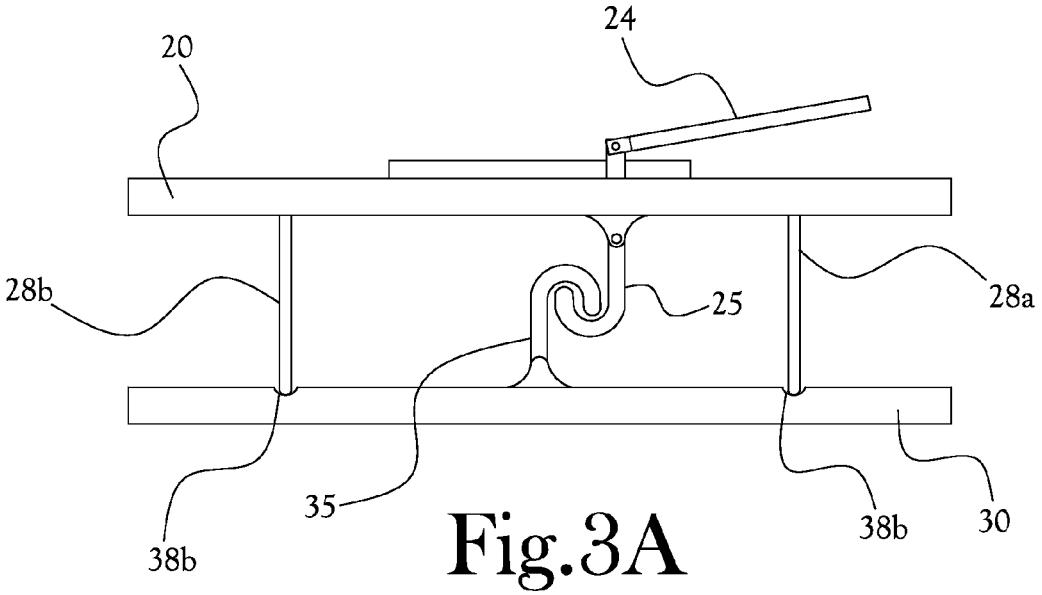
FIG. 3A is a top-down view of the example embodiment shown in FIG. 1, showing the base plate member mounted onto the wall track member and secured in place by the interaction of the hook of the base plate member with the grappling track of the wall track member.
Figure 3B:
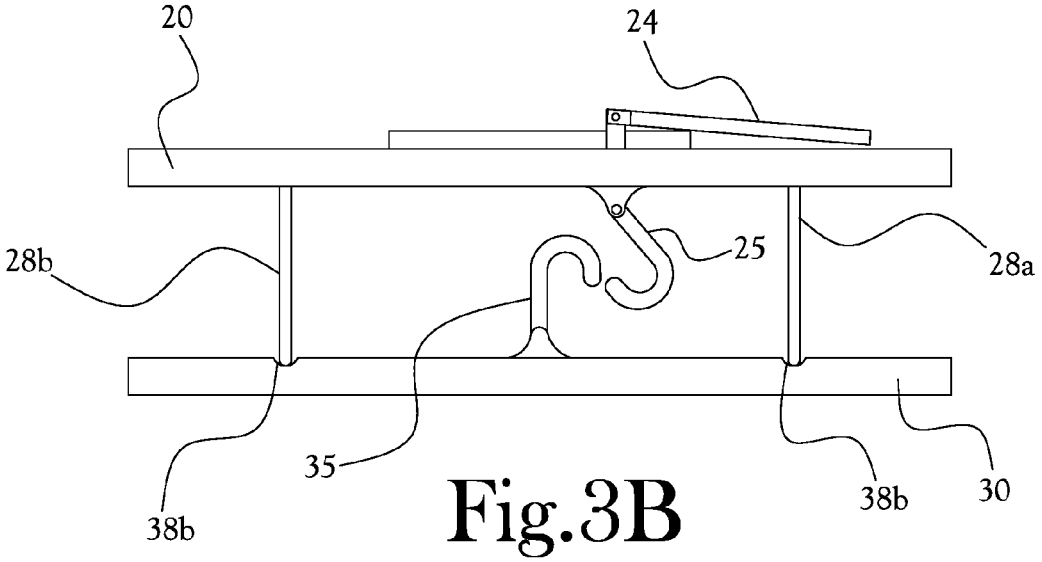
FIG. 3B is a top-down view of the example embodiment shown in FIG. 1 and in FIG. 3B, showing the base plate member decoupled from the wall track member by unhooking the hook of the base plate member from the grappling track of the wall track member.

FIGS. 3A and 3B illustrate how the base plate member 20 is mounted onto and retained on the wall track member 30. The base plate member 20 includes at least one hook 25, which is controlled or manipulated by a lever handle 24. (In the illustrated example embodiment, the base plate member 20 includes two lever handles 24, both positioned and accessible on the outboard face of the base plate member 20, while the hooks 25 are positioned on the inboard face of the base plate member 20, i.e., on the face that faces the wall track member 30.) As shown in FIG. 3A, when the base plate member 20 is positioned in a certain way against the wall track member 30, and the lever handle 24 is in a first position, the hook 25 that is controlled by the lever handle 24 engages with the grappling track 35. The coupling of the hook 25 and the grappling track 35 holds the base plate member 20 in position at a selected vertical location, mounted on the wall track member 30. At the same time, in the illustrated example embodiment, the base plate member 20 includes two positioning panels 28*a* and 28*b*, which generally protrude orthogonally from the inboard face of the base plate member 20. When the base plate member 20 is mounted onto the wall track member 30, the positioning panels 28*a* and 28*b* line up with and interact with the recessed side tracks 38*a* and 38*b* (with, in the illustrated example embodiment, positioning panel 28*a* effectively sliding into or fitting into recessed side track 38*a*, and positioning panel 28*a* effectively sliding into or fitting into recessed side track 38*a*). The positioning panels and recessed side tracks help to orient the base plate member 20 during the mounting process and help to stabilize the base plate member 20 once it is in position on the wall track member 30 and the hook 25 and grappling track 35 have coupled. The vertical tracks allow the base plate member 20 to be mounted onto the wall track member 30 at any one of many possible vertical locations on a wall.

As shown in FIG. 3B, when the lever handle 24 is moved into a second position, the hook 25 decouples from the grappling track 35, allowing the base plate member 20 to be detached from the wall track member 30.

Figure 4:
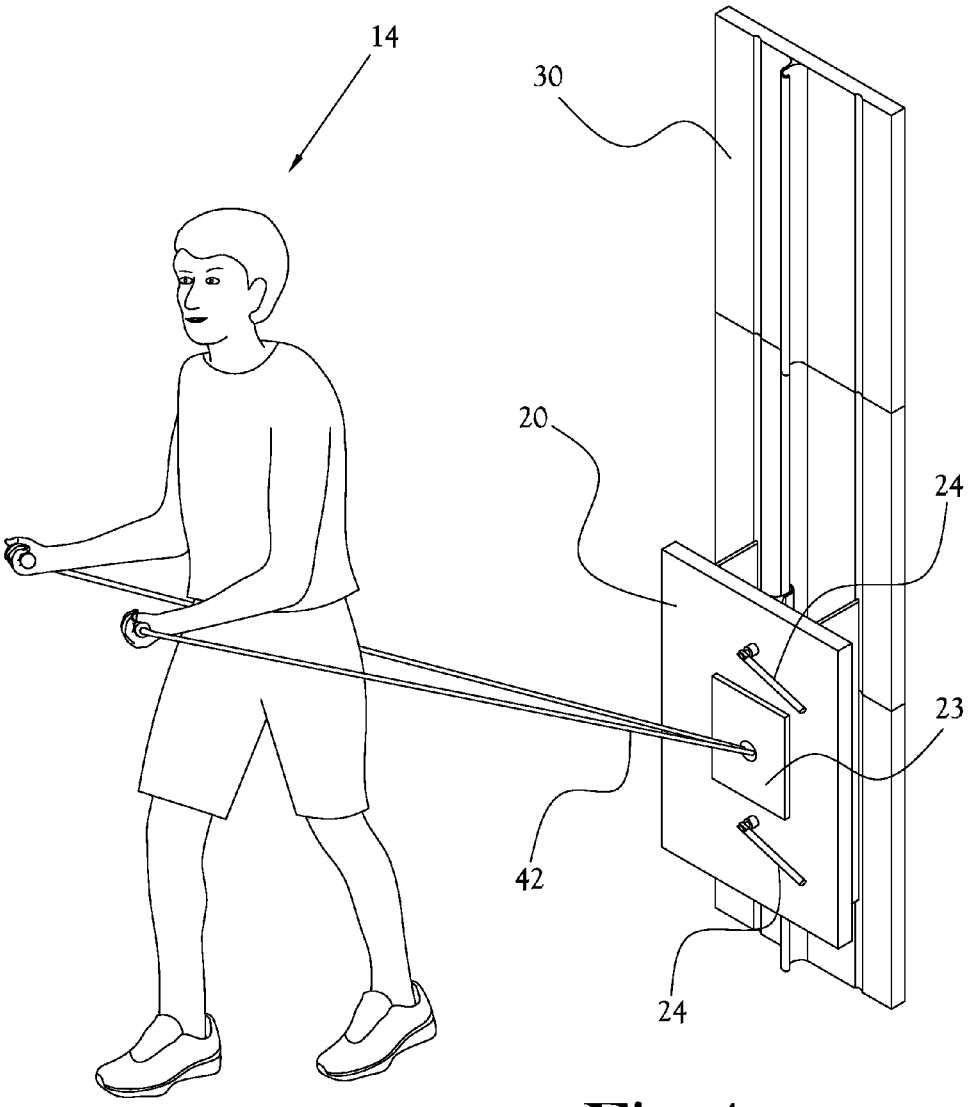
FIG. 4 is a perspective view of a person using one example embodiment of physical therapy system with interchangeable heads according to the present general inventive concept.

FIG. 4 presents a perspective view of a person 14 using one example embodiment of physical therapy system with interchangeable heads according to the present general inventive concept. In the illustrated embodiment, the base plate member 20 is mounted onto the wall track member 30, and the base plate member 20 includes a head component 23 that anchors the exercise equipment 42, which in the illustrated example embodiment includes elastic ropes or other exercise ropes. Those of skill in the art will recognize that other head components and other exercise equipment could be included in, incorporated into, or supported by the base plate member 20. For instance, base plate member(s) 20 could be utilized to support any number of items, including without limitation, a multi-purpose head extending from the wall to be used as a suspension point for a pulley and/or a rope for unweighting or other patient positioning, a weight stack utilizing a pulley system and a rope or a chain, a thoracic or lumbar side bending or backward bending mobilization strap or bar mount, or a shoulder inferior glide bar used in conjunction with a strap or bungee.

Figure 5:
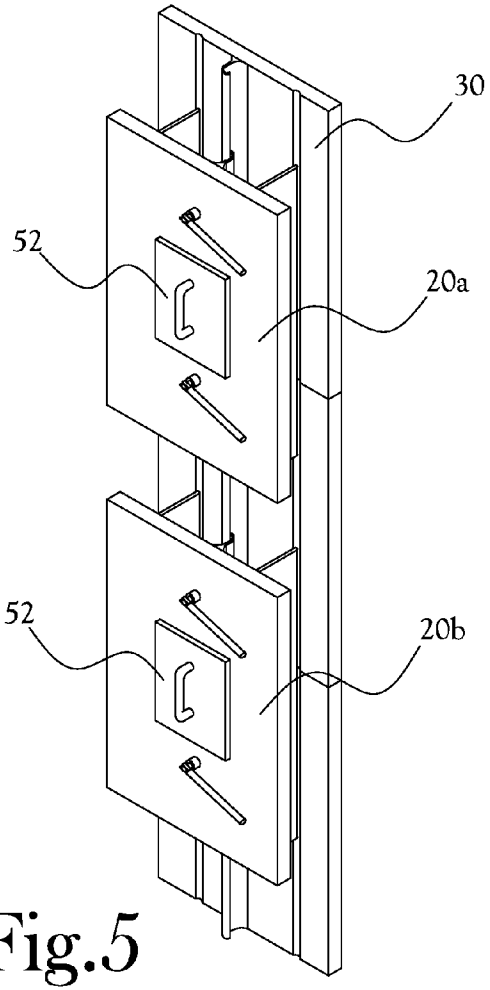
FIG. 5 is a perspective view of an example embodiment of physical therapy system with interchangeable heads according to the present general inventive concept, showing two base plate members mounted onto a single wall track member.

FIG. 5 is a perspective view of an example embodiment of physical therapy system with interchangeable heads according to the present general inventive concept, showing two base plate members 20*a* and 20*b* mounted onto a single wall track member 30. In the illustrated example embodiment, both base plate members 20*a* and 20*b* include the same head component 52. Those of skill in the art will recognize that other head components and other exercise equipment could be included in, incorporated into, or supported by the base plate members 20*a* and 20*b*.

Figure 6:
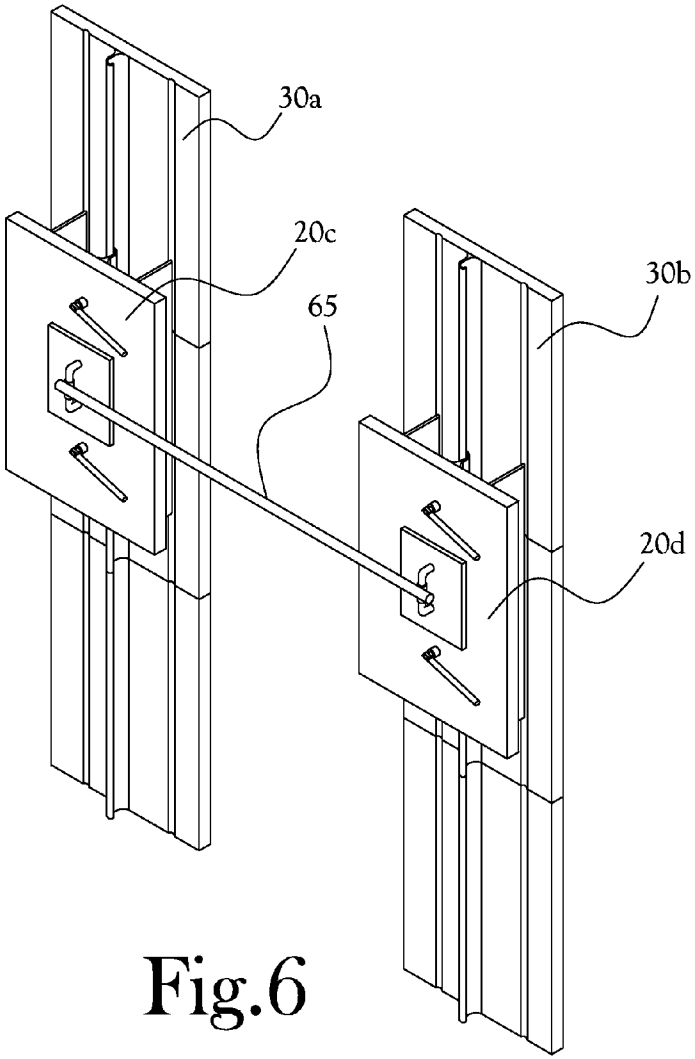
FIG. 6 is a perspective view of an example embodiment of physical therapy system with interchangeable heads according to the present general inventive concept, showing two base plate members combined to support a piece of exercise equipment, each of the two base plate members being mounted onto a separate wall track member.
Figure 9:
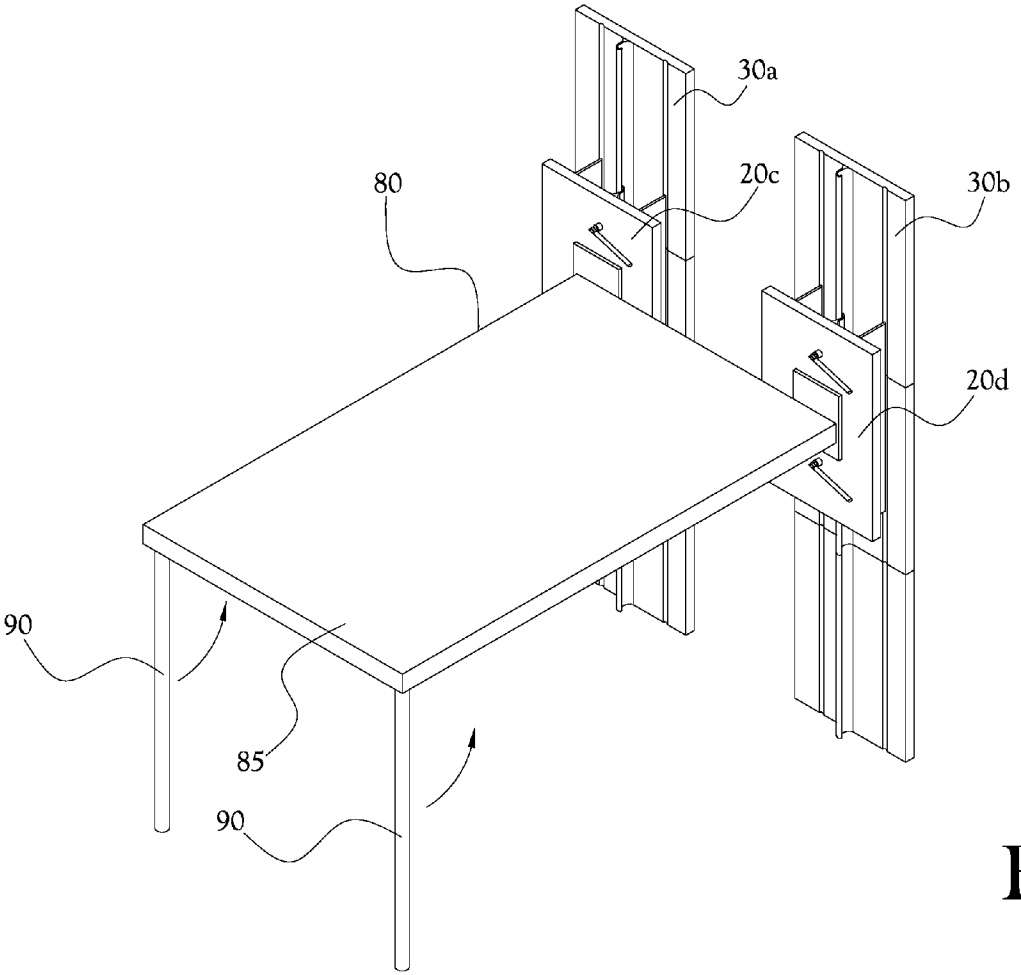
FIG. 9 is a perspective view of an example embodiment of physical therapy system with interchangeable heads according to the present general inventive concept, showing two base plate members combined to support a bed, each of the two base plate members being mounted onto a separate wall track member.

FIG. 6 is a perspective view of an example embodiment of physical therapy system with interchangeable heads according to the present general inventive concept, showing two base plate members 20*c* and 20*d*, each of the two base plate members being mounted onto a separate wall track member 30*a* and 30*b*. As shown in the figure, the two base plate members 20*c* and 20*d* are combined to support a piece of exercise equipment 65, in this case, a bar. In this regard, those skilled in the art that a bar, or a double bar, could be utilized for gait training for use with amputees, etc. Those of skill in the art will recognize that other head components and other exercise equipment could be included in, incorporated into, or supported by the base plate members 20*c* and 20*d*. For instance, as seen in FIG. 9, the two base plate members 20*c* and 20*d* are combined to support a bed 80, which could be used, for example, as a patient massage table. Further, in order to provide additional support for the distal edge 85 of bed 80, a pair of fold-away legs 90 is provided. While in one embodiment, legs 90 are folded when the bed 80 is not in use, those skilled in the art will recognize that there are other means for supporting distal edge 85 of bed 80, for instance legs 90 could be telescoping legs, or could be detachable legs and not depart from the spirit or scope of the present general inventive concept. Additionally, the base plate members 20 of the present invention could be utilized to support a chest or shelf mounted to be used to store supplies or as a writing surface or for supporting a computer for the treating clinician.

Figure 7:
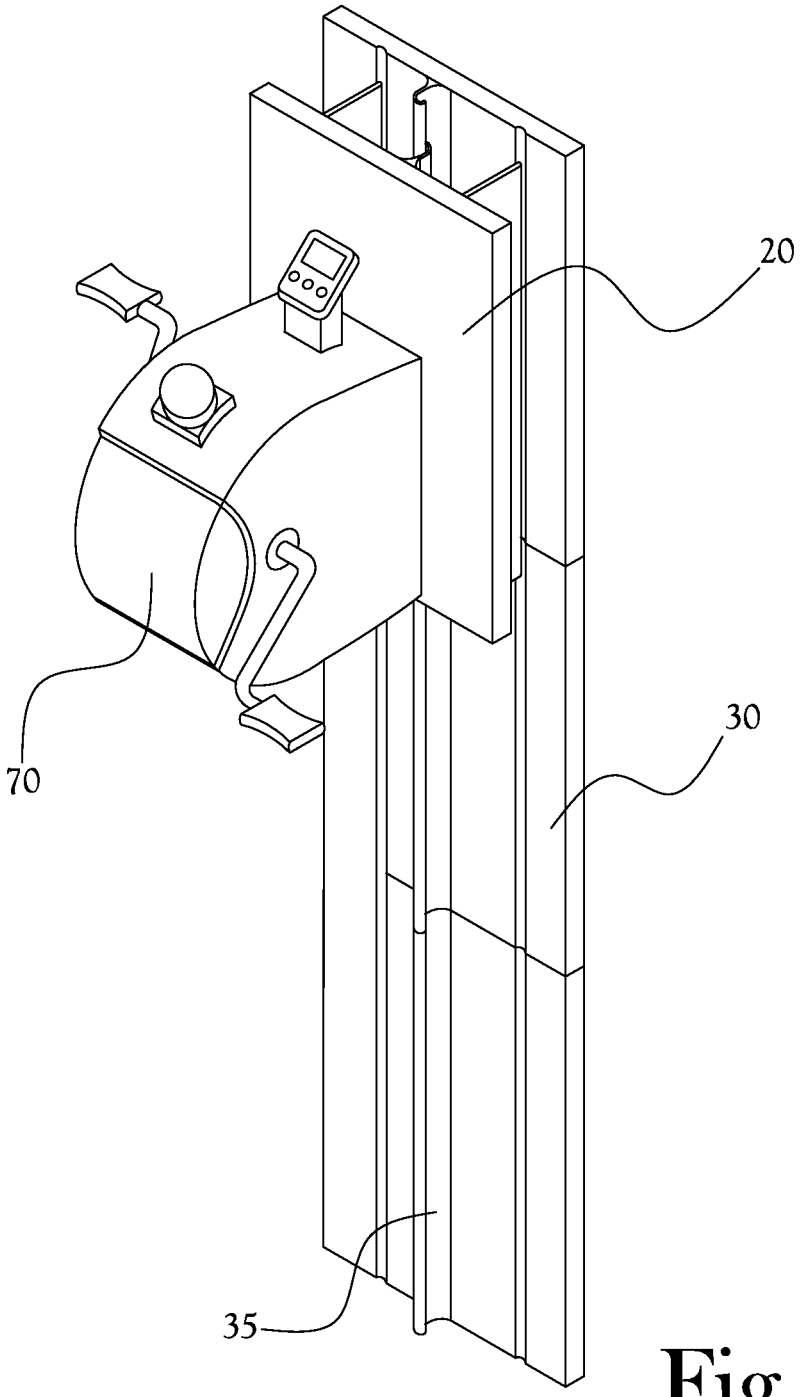
FIG. 7 is a perspective view of a another example embodiment of physical therapy system with interchangeable heads according to the present general inventive concept.
Figure 8:
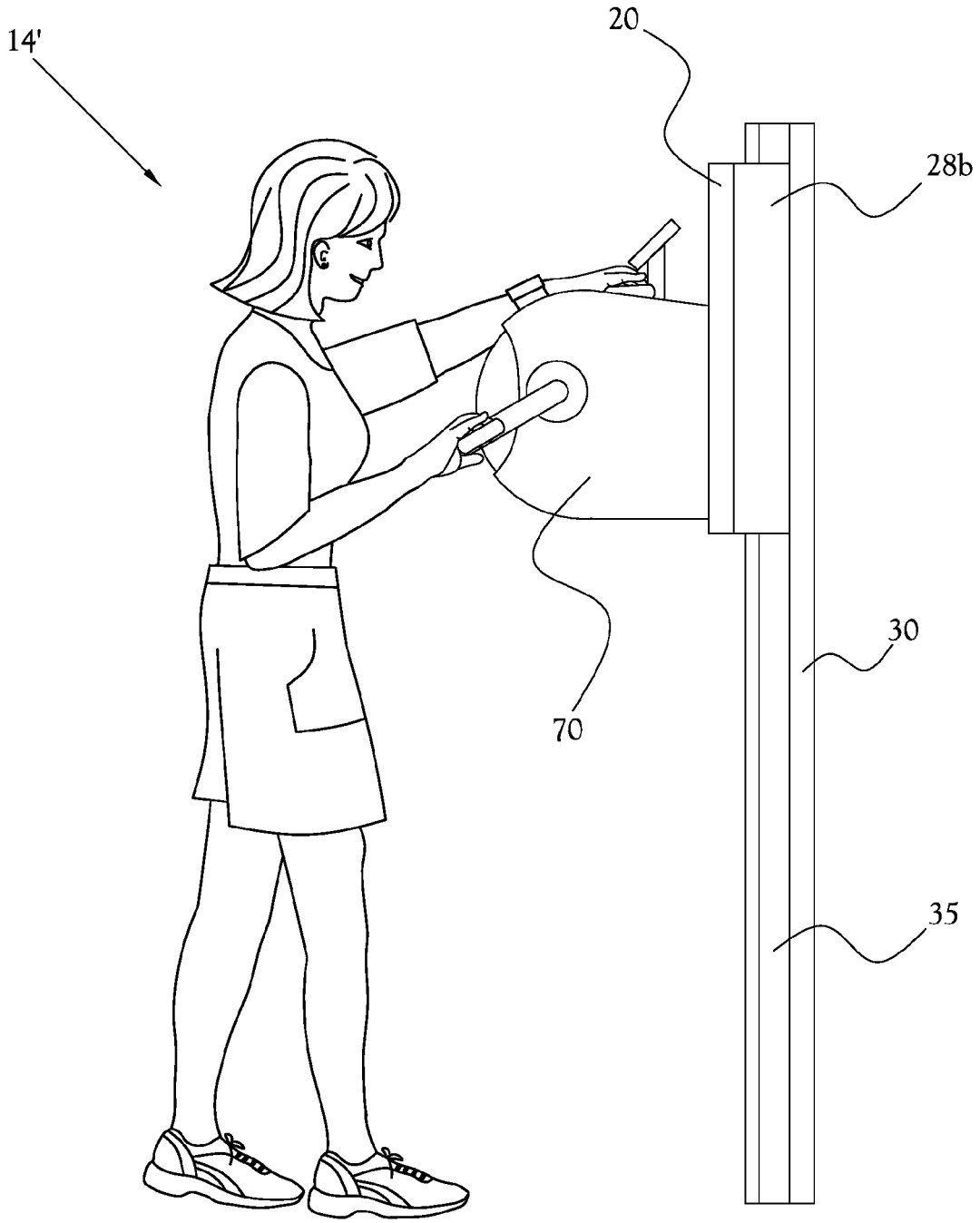
FIG. 8 is a side view of a person the example embodiment shown in FIG. 7.

FIG. 7 is a perspective view of a another example embodiment of physical therapy system with interchangeable heads according to the present general inventive concept, showing a base panel member 20 supporting an exercise machine 70, such as a UBE, an elliptical, a rower, or a weight machine. FIG. 8 is a side view of a person 14' using the exercise machine 70.

A PT system with interchangeable heads according to the present general inventive concept, including a detachable base plate member and a wall track member, provides a means for mounting a selected head component or piece of exercise equipment or exercise machine onto a wall at a selected vertical location. A system according to the present general inventive concept has great potential application in situations where exercise space is at a premium and where it is desirable to be able to interchange exercise equipment or exercise machines in the same physical space. A system according to the present general inventive concept has great potential application in, for example, outpatient clinics, nursing facilities, and physical therapy suites. A PT system with interchangeable heads allows for cost savings and space savings.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A physical therapy system with interchangeable heads comprising:

a wall track member adapted to be secured to a wall, said wall track member including a central grappling track;

a base plate member detachably connected to said wall track member, said base plate member having an inboard face and an outboard face, said base plate member including a hook member positioned on said inboard face and adapted to engage said central grappling track, said base plate member further including a lever handle positioned on said outboard face, said lever handle adapted to control said hook member, wherein said lever handle is selectively operable from a first position in which said hook member engages said grappling track and a second position in which said hook member decouples from said grappling track thereby allowing said base plate to be detached from said wall track member; and a head component supported by said outboard face of said base plate member.

2. The physical therapy system with interchangeable heads of claim 1 wherein said grappling track is i-shaped, and further wherein said hook member is i-shaped.

3. The physical therapy system with interchangeable heads of claim 1 wherein said wall track member further includes at least one recessed side track and said base plate member further includes at least one positioning plate protruding orthogonally from said inboard face of said base plate member wherein said at least one positioning plate aligns with and is received by said at least one recessed side track whereby said base plate member is stabilized on said wall track member.

4. The physical therapy system with interchangeable heads of claim 1 wherein said head component is adapted for carrying a piece of exercise equipment.

5. The physical therapy system with interchangeable heads of claim 1 wherein said base plate member supports an exercise machine.

6. The physical therapy system with interchangeable heads of claim 1 wherein two base plate members are mounted onto a single wall track member.

7. The physical therapy system with interchangeable heads of claim 1 wherein two base plate members support a piece of exercise equipment.

8. A physical therapy system with interchangeable heads comprising:

a wall track member adapted to be secured to a wall, said wall track member including a central grappling track and at least one recessed side track disposed on each side of said central grappling track;

a base plate member detachably connected to said wall track member, said base plate member having an inboard face and an outboard face, said base plate member including a hook member positioned on said inboard face and adapted to engage said central grappling track, said base plate member further including a lever handle positioned on said outboard face, said lever handle adapted to control said hook member, wherein said lever handle is selectively operable from a first position in which said hook member engages said grappling track and a second position in which said hook member decouples from said grappling track thereby allowing said base plate to be detached from said wall track member, at least one positioning plate disposed on each side of said hook member protruding orthogonally from said inboard face of said base plate member wherein said at least one positioning plate aligns with and is received by said at least one recessed side track whereby said base plate member is stabilized on side wall track member; and a head component supported by said base plate member, wherein said head component is adapted for carrying a piece of exercise equipment.

9. The physical therapy system with interchangeable heads of claim 8 wherein said grappling track is i-shaped, and further wherein said hook member is i-shaped.

10. The physical therapy system with interchangeable heads of claim 8 wherein two base plate members are mounted onto a single wall track member.

11. The physical therapy system with interchangeable heads of claim 8 wherein two base plate members support a piece of exercise equipment.

12. The physical therapy system with interchangeable heads of claim 8 wherein two base plate members support a bed.

13. A physical therapy system with interchangeable heads comprising:

a first wall track member adapted to be secured to a wall, said wall track member including a first central grappling track and at least one recessed side track disposed on each side of said first central grappling track;

a second wall track member adapted to be secured to a wall, said wall track member including a second central grappling track and at least one recessed side track disposed on each side of said second central grappling track;

a first base plate member detachably secured to said fist wall track member and a second base plate member detachably secured to said second wall track member, each said base plate member having an inboard face and an outboard face, each said base plate member including a hook member positioned on said inboard face and adapted to engage said central grappling track, each said base plate member further including a lever handle positioned on said outboard face, said lever handle adapted to control said hook member, wherein said lever handle is selectively operable from a first position in which said hook member engages said grappling track and a second position in which said hook member decouples from said grappling track thereby allowing said base plate to be detached from said wall track member, wherein each said base plate member further includes a head component supported by said base plate member;

a positioning plate disposed on at least one side of said hook member protruding orthogonally from said inboard face each said base plate member wherein said positioning plate aligns with and is received by said recessed side track whereby said base plate member is stabilized on said wall track member; and wherein said first base plate member and said second base plate member cooperate to support a piece of equipment.

14. The physical therapy system with interchangeable heads of claim 13 wherein said head component is adapted for carrying said piece of equipment.

15. The physical therapy system with interchangeable heads of claim 13 wherein said piece of equipment is an exercise machine.

16. The physical therapy system with interchangeable heads of claim 13 wherein said piece of equipment is a bar.

17. The physical therapy system with interchangeable heads of claim 13 wherein said piece of equipment is a bed.

* * * * *